US005749497A

United States Patent [19]

Davis

[11] Patent Number: 5,749,497

[45] Date of Patent: May 12, 1998

[54] CONTAINER AND RETRACTABLE HANGER SYSTEM

[75] Inventor: Brian T. Davis, Waterford, Wis.

[73] Assignee: S. C. Johnson & Son, Inc., Racine, Wis.

[21] Appl. No.: 679,464

[22] Filed: Jul. 3, 1996

[51] Int. Cl.[6] ..... B67D 5/06

[52] U.S. Cl. ..... 222/181.2; 222/212; 215/399; 248/311.3; 248/682

[58] Field of Search ..... 222/181.2, 212; 248/682, 339, 311.3; 215/399

[56] References Cited

U.S. PATENT DOCUMENTS

| | | | |
|---|---|---|---|
| D. 273,940 | 5/1984 | Soos et al. . | |
| D. 294,121 | 2/1988 | Cramer . | |
| D. 300,511 | 4/1989 | Cramer . | |
| D. 347,385 | 5/1994 | Kunesh . | |
| 2,362,523 | 10/1944 | Armstrong, Jr. et al. . | |
| 3,484,013 | 12/1969 | Speicher . | |
| 4,093,169 | 6/1978 | Winchell | 215/399 X |
| 4,282,980 | 8/1981 | Winchell | 215/399 |
| 4,301,935 | 11/1981 | Gokcen et al. | 215/399 |
| 4,460,143 | 7/1984 | Ohama . | |
| 4,747,519 | 5/1988 | Green et al. . | |
| 4,998,647 | 3/1991 | Sharp . | |
| 5,427,343 | 6/1995 | Ferris . | |
| 5,667,107 | 9/1997 | Lindsey | 222/181.2 X |

FOREIGN PATENT DOCUMENTS 1035796 8/1986 United Kingdom .

*Primary Examiner*—Gregory L. Huson

[57] ABSTRACT

A container and retractable hanger system includes a container having a dispenser at one end and a face with a depression at an opposite end. The depression has a recessed face. A cylindrical boss extends a distance from the recessed face of the depression. A lip extends from a portion of the boss. An elongated, elastic hanger has (i) a hook at one end, (ii) a coupler with an opening at an opposite end, the coupler being pivotally couplable with the boss by insertion of the portion of the boss having the lip through said coupler, (iii) a hinge adjacent the coupler between the hook and the coupler, and (iv) a loop defining a slot between the hook and the hinge. The slot is configured to hold a safety razor or other consumer item.

13 Claims, 2 Drawing Sheets

CONTAINER AND RETRACTABLE HANGER SYSTEM

BACKGROUND OF THE INVENTION

1. Field of the Invention

The present invention relates to a container and retractable hanger system, typically for consumer use, and more particularly to a container and retractable hanger system in which the container can either hang by the hanger or stand on either of its ends when the hanger is retracted, and which provides a mechanism for holding safety razors, for example.

2. Description of the Related Art

Various attempts have been made over the years to provide mechanisms for suspending containers. Applications have ranged from suspended intravenous fluid vials to hanging shampoo containers. In household use, efforts have focused primarily on providing arrangements for alleviating the clutter in the shower or bath that can result from the use of bottles containing shampoos, conditioners, liquid soaps, and other liquids. With the proliferation of such products on the market, many consumers keep more containers in their showers than the limited ledge space can accommodate. Therefore, much effort has been directed toward reducing the inevitable clutter.

U.S. Pat. No. 4,747,519 to Green, et al., for a "Hanger System for a Container" discusses one such approach, in which a container has a concave portion in the end opposite its dispensing opening. Disposed within the concave portion is a hanger attachment lug, which includes a circular shaft portion and a retention flange. A detachable hanger is provided which includes a hook at one end and an attachment clip at the other. The attachment clip engages the shaft portion of the attachment lug behind the retention flange. While this approach is generally useful for hanging the container, and allows the container to be rotated relative to the hanger, it has its drawbacks. For example, once the hanger is attached to the container, the container cannot stand on its end opposite the dispenser. Therefore, in order to switch between hanging the container and resting it on its end, the consumer would have to repeatedly attach and detach the hanger from the container.

U.S. Pat. No. 5,427,343 to Ferris, for a "Plastic Container Hanger" describes a similar container hanger. In this patent, a hanger support is screwed directly into the base of a container. This arrangement suffers the same problems as those discussed above with respect to the Green, et al. patent, with the additional drawback that once the hanger is screwed into the container, it is, for all practical purposes, permanently affixed until the container is empty.

Similar approaches have been taken in non-consumer product fields. For instance, U.S. Pat. No. 4,460,143 to Ohama, for a "Vial Suspender" discloses a device for suspending vials containing pharmaceutical solutions, nutrient solutions, and the like. A base plate is fastened to the bottom of a vial with a heat-shrunken resin film. A suspending strip is hinged to the center of the base plate. A suspending ring is hinged to the outer end of the suspending strip. The suspending strip and the suspending ring can collapse into recesses provided in the base plate. While the collapsibility of the suspending ring and suspending strip does allow the vial to be alternately hung and stood on its end, this arrangement does not allow the vial to be rotated freely, which hampers its utility for the purposes to which the present invention is directed.

U.S. Pat. No. 3,484,013 to Speicher, for a "Container Having Suspension Means" describes a container with a concave bottom within which a hook is hinged by a lug. A lip is provided on the lug to hold the hook flush against the bottom of the container when it is retracted.

U.S. Pat. No. 2,362,523 to Armstrong, et al., for a "Suspension Member" similarly discloses a suspension member for use with flasks used in dispensing intravenous solutions. A metal plate is provided with a hook stamped out of one side. Forming the periphery of the plate is a pair of diametrically opposed ears, each formed at its outer end into an inwardly facing channel. The suspension member may be detachably secured on the base of a flask by springing the channels over diametrically opposed beads provided on the base of the flask.

Normally, the hook is coplanar with the plate and therefore, with the base of the flask. When it is desired to hang the flask to dispense the contents, the hook is bent outwardly through 90°.

Both the Speicher and Armstrong, et al. patents suffer from the same limitations as does that of the Ohama patent, discussed above. In addition, both arrangements are limited by their design to utilize hooks which do not have a length exceeding a radii of the containers they are designed to hang. Further, the hook of the Armstrong, et al. device must be permanently deformed to be in a hanging position. The metal at the base of the hook will be weakened each time it is bent and unbent, likely leading to eventual failure.

Not only do consumers have shampoo, soap and conditioner containers cluttering their showers, but many keep shaving implements in their showers as well. As with the containers discussed above, it is often difficult just to find enough space to keep a razor in the shower, let alone, to keep one safely. In addition, although the blades are usually made of stainless steel, it is generally detrimental to razors if they are constantly wet. Therefore, it is desirable to provide a means to keep the razor in a shower, but away from the water when not in use. None of the mechanisms described thus far make any provision for razor storage. Most attempts in this regard have been incorporated into a bulky and complicated apparatus.

For instance, U.S. Pat. No. 4,998,647 to Sharp, for a "Detachable Dispenser and Hanging Support" describes a hanging support which has detachable containers, a removable platform for soap, brushes and sponges, and hooks for hanging razors, wash cloths, swim wear and the like. The entire support is hung on a shower head, for example, by an adjustable strap. While this and other arrangements are quite comprehensive in that they do provide a means for containing just about anything a consumer would want to have in a shower, these devices are quite bulky and complicated, and they often get in the way of the consumer. Further, these devices are generally too heavy and awkward to hang from the shower curtain rod, and they are generally in the way when hung on the shower head itself.

Accordingly, there is a need in the art for a compact hanging apparatus for use with containers for shampoo, conditioner, and the like.

There is an additional need for such an apparatus and container combination which allow the container to be stood on either end with the hanging mechanism in place.

There is a further need in the art for such a mechanism and container which permit the container to be rotated while it is hung in a desired location.

There is yet an additional need in the art for such a hanging mechanism which provides a means for hanging a razor therein.

SUMMARY OF THE INVENTION

An object of the invention is to address the foregoing needs in the art and to provide a container and retractable hanger system of utmost convenience.

It is a further object to provide a compact hanging apparatus for use with containers for shampoo, conditioner, shave preparation, and the like.

It is another object to provide such an apparatus and container combination which allows the container to be stood on either end with the hanging mechanism in place.

It is a further object to provide such a hanging mechanism and container which permit the container to be rotated while it is hung in place.

It is yet an additional object to provide such a hanging mechanism which provides a means for hanging a razor therein.

According to one aspect of the present invention, a container and retractable hanger system includes a container having a dispenser at one end, a cylindrical boss extending from an opposite end or hanger end extending between the ends, and a lip extending from a portion of the boss.

An elongated, elastic hanger has (i) a hook at one end, (ii) a coupler with an opening, with which the boss is pivotally couplable by insertion of the portion with the lip through the coupler, at an hanger end, and (iii) a hinge adjacent the coupler between the hook and the coupler.

The one end of said container can be substantially flat, and the hanger end can have a substantially flat end face and a recessed face from which the boss extends a distance. The recessed face can be recessed from the end face a depth greater than or equal to the distance by which the boss extends from the recessed face.

The one end of the container and the end face of the hanger end of the container can be substantially parallel, so that the container can stand on either of its ends.

The recessed face can extend to a perimeter of the hanger end of the container, and the hanger can be foldable at the hinge so that the hook can rest against the side of the container when the coupler is coupled with the boss.

The hanger can further comprise a loop defining a slot between the hinge and the hook. This slot can be configured to hold a safety razor, for example.

A first length from a center of the opening of the coupler to the hinge can be greater than or equal to a second length from a center of the boss to the perimeter of the hanger end of the container so that the hanger is foldable at the hinge against the side of the container. A third length from the hinge to the one end of the hanger should preferably not be longer than the side of the container so that the container can stand on either end.

According to another aspect of the present invention, a container and retractable hanger system includes a container having a dispenser at one end and an end face with a depression at an hanger end. The depression has a recessed face. A cylindrical boss extends a distance from the recessed face of the depression. A lip extends from a portion of the boss. An elongated, elastic hanger has (i) a hook at one end, (ii) a coupler with an opening at an hanger end, the coupler being pivotally couplable with the boss by insertion of the portion with the lip through the coupler, (iii) a hinge adjacent the coupler between the hook and the coupler, and (iv) a loop defining a slot between the hook and the hinge, the slot being configured to hold a safety razor, for example.

According to another aspect of the present invention, a hanger is provided for hanging a container. The hanger includes a hook, and a coupler pivotally couplable with the container at an hanger end of the hanger from the hook. A hinge is adjacent the coupler between the hook and the coupler. A loop defines a slot between the hook and the hinge, the slot being configured to hold a safety razor, for example.

According to a further aspect of the present invention, a container and retractable hanger system includes a container having a dispenser end, a base end, and a side extending between the dispenser end and the base end. The container has a dispenser at the dispenser end. A hanger includes a coupler end and a hook end. The hanger has a coupler at the coupler end which is pivotally couplable to the base end of the container. The hanger has a hook disposed at the hook end and a hinge disposed adjacent the coupler between the coupler and the hook so that the hook is foldable against the side of the container.

This brief summary of the invention has been provided so that the nature of the invention may be generally understood. However, this summary should not be construed to limit the invention.

The foregoing and other objects, aspects, features and advantages of the present invention will become apparent from the following detailed description of the preferred embodiments in conjunction with the accompanying drawings, in which like numbers reference like elements.

DETAILED DESCRIPTION OF THE PREFERRED EMBODIMENTS

Figure 1:
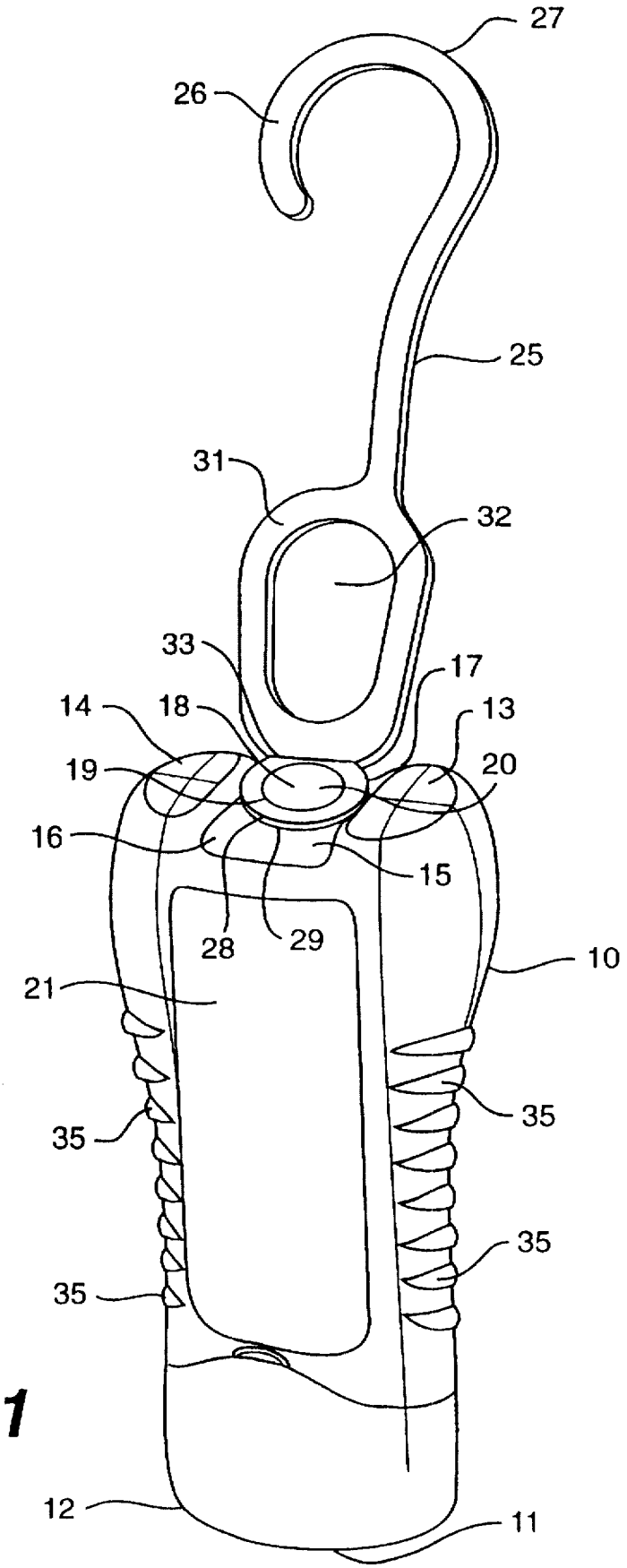
FIG. 1 is a perspective view of a preferred embodiment of the container and retractable hanger system of the present invention.

FIG. 1 shows a perspective view of a preferred embodiment of a container and retractable hanger system of the present invention. A bottle or container 10 is provided with a dispenser 11 at one end 12. At the other end 13, a hanger 25 can be coupled to the container 10, as will be discussed in more detail below. This hanger 25 allows the container 10 to be suspended from a shower curtain rod, shower head, or towel bar, (not shown) for example.

As will be discussed in more detail below, it is preferred that the hanger 25 and the container 10 can pivot relative to one another. This allows the container 10 to hang evenly, as well as permits the container 10 to be hung in various places and in various orientations. The hanger 25 is hinged so that it can fold against the container 10. This is done in a manner to permit the container 10 to stand on either of its ends 12, 13 with the hanger 25 coupled thereto. An additional feature of the present invention is that the hanger 25 is configured to hold a safety razor, for example.

The particular materials and construction of the container 10 will be determined primarily by the characteristics of the liquid it is designed to hold. In its preferred application, although not limited to this, the container 10 is designed for consumer use, to hold shampoo, conditioner, liquid soap, shave preparations, or the like. In this case, the container 10 should be of a high density polyethylene which has proven to be conducive to blow-molding into whatever shape is desired, or other like material such as low density polyethylene, polyvinyl chloride, or polyethylene terephthalate. It is shown that side 21 of the container 10 is configured so that the overall container 10 has an "hourglass" shape. This design is not necessary to the function of the container 10, and other shapes may be employed. Ribs 35 can be provided to aid the consumer in grasping the container 10.

The container 10 is preferably substantially flat at both of its ends 12, 13 so that it can be stood on either end. The dispenser 11 can be of any standard construction. It is preferred that the dispenser 11 has a flip top opening or other equivalent conventional dispensing opening (not shown) so that the end 12 of the container will be flat. The cap may also be removable. At the hanger end (or base) 13, an end face 14 is provided which is substantially flat. A depression 15 is provided in the end face 14. At the bottom of the depression 15 is preferably a recessed face 16. This depression 15 and recessed face 16 extend to at least one perimeter 17 of the base 13, for reasons that will be made clear later.

A boss 18 for coupling with the hanger 25 is provided on the recessed face 16. The boss 18 has a circular cross section, a feature which will permit the hanger 25 to pivot when it is coupled to the container 10. A flange 19 is provided at or near the head 20 of the boss 18 to hold the hanger in place once coupled to the boss 18. The boss 18 sits entirely within the depression 15, so that it does not extend past the end face 14. Thus, the boss 18 does not impair the ability of the container 10 to stand on its base 13.

The hanger 25 is also preferably molded of a flexible plastic, preferably polypropylene or a like flexible material, such as glass-filled polypropylene composite, polyethylene, or nylon. Also, other suitable thermoplastic elastomers or vinyl polymers may be used. Polypropylene has proven to be well suited for this application because it has sufficient strength to resist "relaxing" under the constant stress due to the weight of the hanging container 10. A hook 26 is provided at one end 27 of the hanger 25. An annular coupler 28 is provided at the other end 29. The boss 18 of the container 10 engages with the annular coupler 28 by insertion through a circular opening 30 in the annular coupler 28. The coupler 28 is positioned behind the flange 19 in production so that it is held in engagement with the boss 18. Once in position, the hanger 25 can pivot on the boss 18. Thus, it is preferred that the boss 18 and the opening of the coupler 28 be circular in shape. This allows the hanger 25 to pivot 360° relative to the container 10. As discussed above, this feature permits the container to hang more evenly, and increases the flexibility of use in that it can be hung in various places and orientations.

When coupled to the boss 18, the annular coupler 28 sits entirely within the depression 15 in the end face 14 of the container 10. Thus, as will be discussed later, the coupler 28 will not impair the ability of the container 10 to be stood on that end 13.

The hanger 25 includes a loop 31 provided between the hinge 33 and the hook 26. The loop 31 defines a slot 32, which is adapted to hold a safety razor (not shown), for example. Preferably, the slot 32 is larger at its top to facilitate the insertion of the safety razor or like implement therethrough. Once inserted, the safety razor or like implement merely hangs from its head in engagement with the loop 31. Of course, other items can be retained in slot 32, as desired.

Figure 2:
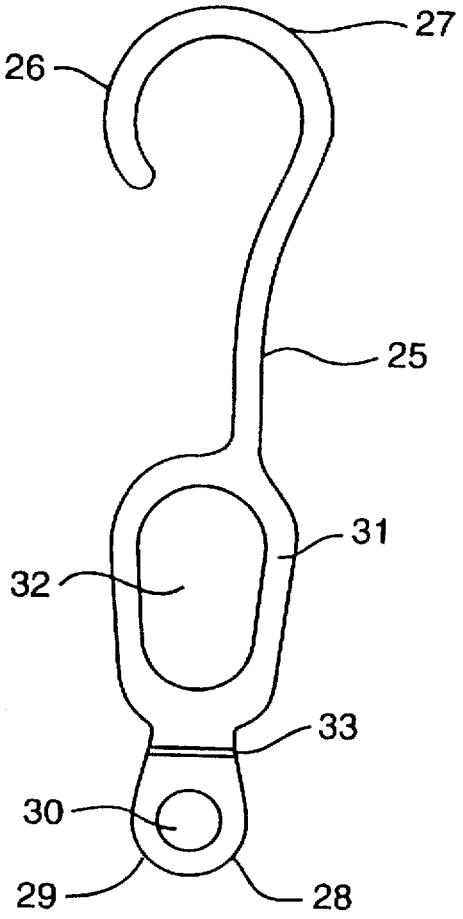
FIG. 2 is an elevational view of a preferred embodiment of the hanging mechanism of the present invention.

FIG. 2 is an elevational view of the hanger 25 of the preferred embodiment of the present invention. Between the coupler 28 and the loop 31 is a hinge 33. In this embodiment, hinge 33 is a portion of the hanger 25 which is molded to have a reduced thickness, preferably by molding arcuate channels across the width of the hanger 25. The flexibility of the hanger 25 plays a key role in the operation of the hinge 33. Of course, other equivalent hinge mechanisms can be used as desired. Because the hinge 33 is designed for repetitive folding and unfolding, the flexibility of the hanger 25 reduces the amount of plastic deformation that will occur, and the hanger 25 will last longer.

The hinge 33 is located adjacent to the coupler 28. The distance from the center of the circular opening 30 of the coupler 28 to the hinge 33 is slightly greater than the distance from the center of the boss 18 to the perimeter 17 of the base 13 of the container 10 (best illustrated in FIG. 1). This permits the hanger 25 to be folded at the hinge 33 against the side 21 of the container.

It is contemplated that hanger 25 could also include additional convenience hooks or protrusions (not shown) spaced above loop 31 and below hook 26 on the surface of hanger 25.

In addition, while it is preferred that the distance from hinge 33 to the end of hook 26 be less than the length of the container 10 so that hanger 25 can be folded against the container 10, it is possible, as an alternate embodiment(not shown), that the hanger have a second hinge so that the hanger is folded upon itself acordian style for storage.

Figure 3:
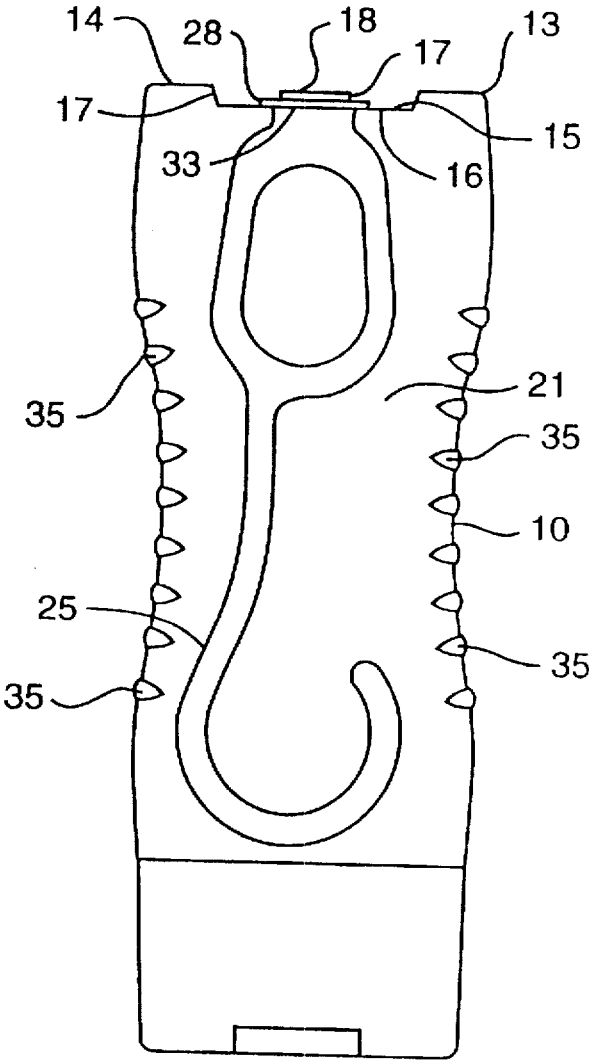
FIG. 3 is a rear view of the present invention with the hanging mechanism folded alongside the container.

FIG. 3 shows a rear view of the present invention with the hanging mechanism 25 in a retracted position, folded alongside the container 10. This is made possible by a combination of several of the features of the present invention already discussed. Primarily, this is possible because the depression in the end face 14 extends to the perimeter 17 of the base 13, and due to the juxtaposition of the hinge 33 and the coupler 28. These features combine to permit the hanger 25 to fold against the side 21 of the container 10. It is preferred that the hanger 25 not be longer from its hinge 33 to its end 27 than the container 10. This prevents the hanger 25 from extending past the container 10 when folded against its side 21.

In addition, because the boss 18 and the coupler 28 fit entirely within the depression 15 of the end face 14, the container 10 can stand on its base 13 when the hanger 25 is coupled to the container 10. Folding the hanger 25 against the side 21 of the container 10 also facilitates shipping and packaging the system. Also, once the product is opened, the hanger 25 can be refolded to make the product less bulky and awkward, which facilitates packing for travelling. In addition, container 10 can have an indent (not shown) the size and shape of a portion of hook 26 so that hook 26 can be clipped to the side of container 10. In addition, the consumer will not have to constantly remove the hanger 25 in order to stand the container 10 on its base 13 and then re-attach it to hang the container 10.

INDUSTRIAL APPLICABILITY

The hanging container of the present invention can be used wherever it is desired to provide a container which can be hung from the end opposite its dispenser and which can be stood on either of its ends. It is particularly well suited for use with shampoo, conditioner, shave preparations or liquid soap containers for the shower, for example, where shelf space is limited. In addition, it can be used to provide a compact and convenient razor-hanging mechanism.

Although specific embodiments of the present invention have been described in detail, it will be understood that this description is merely for purposes of illustration. Various modifications of and equivalent structures corresponding to the disclosed aspects of the preferred embodiments in addition to those described above may be made by those skilled in the art without departing from the spirit of the following claims.

For example, the boss 18 could have a plurality of tabs or knobs instead of a continuous flange 19, as long as some sort of a lip is provided to hold the coupler 28 in place. These flange alternatives are also conducive to an alternate feature whereby the coupler 28 is selectively disengageable from the boss 18 of the container 10, allowing the consumer to detach and re-attach the hanger 25 as desired. It is also not necessary for the flange 19 (or tabs) to be located at the head 20 of the boss 18. All that is preferred is that the coupler fit behind the flange 19, and the boss 18 not extend out of the depression 15. The outer shape of the coupler 28 is not vital, as long as the opening 30 therethrough is circular, and the coupler 28 does not interfere with the rotation of the container 10. Further, as discussed, the container 10 could have a shape other than an "hourglass" shape.

Those of ordinary skill in the art will appreciate that certain other variations in size, shape, number, arrangement and material of various portions of the disclosed hanging connector may be made without departing from the spirit of the invention. Accordingly, the scope of the invention defined by the following claims should be afforded the broadest reasonable interpretation so as to encompass such modifications and equivalent structures.

What is claimed is:

1. A container and retractable hanger system comprising:

a container having a dispenser at one end, a cylindrical boss extending from an opposite end, a side extending between said ends, and a lip extending from a portion of said boss; and an elongated, elastic hanger having (i) a hook at one end, (ii) a coupler with an opening, with which said boss is pivotally couplable by insertion of said portion with said lip through said coupler, at an opposite end, and (iii) a hinge adjacent said coupler between said hook and said coupler.

2. The system of claim 1, wherein:

said one end of said container is substantially flat, said opposite end has a substantially flat end face and a recessed face from which said boss extends a distance, said recessed face being recessed from said end face a depth greater than or equal to the distance by which said boss extends from said recessed face, and said one end of said container and said end face of said opposite end of said container are substantially parallel, so that said container can stand on either of said ends.

3. The system of claim 2, wherein said recessed face extends to a perimeter of said opposite end of said container, and said hanger is foldable at said hinge so that said hook can rest against said side of said container when said coupler is coupled with said boss.

4. The system of claim 3, wherein said hanger further comprises a loop defining a slot between said hinge and said hook, said slot being configured to hold a safety razor.

5. The system of claim 1, wherein a first length from a center of the opening of said coupler to said hinge is greater than or equal to a second length from a center of said boss to said perimeter of said opposite end of said container so that said hanger is foldable at said hinge against said side of said container, and wherein a third length from said hinge to said one end of said hanger is not longer than said side of said container.

6. A container and retractable hanger system comprising:

a container having a dispenser at one end and an end face with a depression at an opposite end, said depression having a recessed face;

a cylindrical boss extending a distance from said recessed face of said depression;

a lip extending from a portion of said boss; and an elongated, elastic hanger having (i) a hook at one end, (ii) a coupler with an opening at an opposite end, said coupler being pivotally couplable with said boss by insertion of said portion with said lip through said coupler, (iii) a hinge adjacent said coupler between said hook and said coupler, and (iv) a loop defining a slot between said hook and said hinge, said slot being configured to hold a safety razor.

7. The system of claim 6, wherein:

said one end of said container is substantially flat, said end face of said opposite end is substantially flat, and said recessed face within said depression is recessed a depth from said end face, the depth by which said depression is recessed being greater than or equal to the distance by which said boss extends from said recessed face, and said one end of said container and said end face of said opposite end of said container are substantially parallel, so that said container can stand on either of said ends.

8. The system of claim 7, wherein said depression extends to a perimeter of said opposite end of said container, and said hanger is foldable at said hinge so that said hook can rest against a side of said container when said coupler is coupled with said boss.

9. The system of claim 8, wherein a first length from a center of the opening of said coupler to said hinge is greater than or equal to a second length from a center of said boss to said perimeter of said opposite end of said container so that said hanger is foldable at said hinge against said side of said container, and wherein a third length from said hinge to said one end of said hanger is not longer than said side of said container.

10. A hanger for hanging a container, said hanger comprising:

a hook;

a coupler pivotally couplable with the container at an opposite end of said hanger from said hook;

a hinge adjacent said coupler between said hook and said coupler; and and a loop defining a slot between said hook and said hinge, said slot being configured to hold a safety razor.

11. The hanger of claim 10, wherein said hanger is elastic, and wherein said coupler has an opening configured to accept a cylindrical boss with a lip disposed at an end of the container.

12. A container and retractable hanger system comprising:

a container having a dispenser end, a base end, and a side extending between said dispenser end and said base end, said container having a dispenser at said dispenser end;

a hanger having a coupler end and a hook end, said hanger having a coupler at said coupler end which is pivotally couplable to said base end of said container at a first distance from said side of said container, said hanger having a hook disposed at said hook end and a hinge disposed adjacent said coupler between said coupler and said hook at a second distance from said coupler said coupler greater than said first distance so that said hook is foldable against said side of said container.

13. The system of claim 12, wherein said dispenser end and said base end of said container each has a substantially flat face, wherein said face of said base end has a depression, and wherein said coupler rests within said depression when pivotally coupled to said container when said hook is folded against said side of said container.

* * * * *